United States Patent [19]

Eisenman

[11] Patent Number: 4,625,886

[45] Date of Patent: Dec. 2, 1986

[54] LIQUID SURFACE SEALING DEVICE

[76] Inventor: Nancy K. Eisenman, 34 Lincoln La., Simsbury, Conn. 06070

[21] Appl. No.: 825,217

[22] Filed: Feb. 3, 1986

[51] Int. Cl.[4] ..... B65D 88/34

[52] U.S. Cl. ..... 220/216; 220/267; 215/231

[58] Field of Search ..... 220/216, 267, 217, 364, 220/354, 260; 215/231; 53/412, 489, 381 A, 492

[56] References Cited

U.S. PATENT DOCUMENTS

| | | | |
|---|---|---|---|
| 1,818,924 | 8/1931 | Basmadjian | 215/231 |
| 2,007,584 | 7/1935 | Peckham | 220/267 |
| 2,556,195 | 6/1951 | Kors | 220/216 X |
| 2,609,119 | 9/1952 | Shilstone | 220/216 X |
| 3,235,123 | 2/1966 | Frankenberg | 220/267 |
| 3,256,977 | 6/1966 | Pettersen | 220/216 X |
| 3,266,662 | 8/1966 | Craig | 220/216 X |
| 3,349,945 | 10/1967 | Baker | 220/216 |
| 3,379,333 | 4/1968 | Navia | 220/267 |
| 4,413,747 | 11/1983 | Tenold et al. | 220/216 X |

FOREIGN PATENT DOCUMENTS

| | | | |
|---|---|---|---|
| 1011464 | 7/1981 | U.S.S.R. | 220/216 |

*Primary Examiner*—Horace M. Culver

*Attorney, Agent, or Firm*—McCormick, Paulding & Huber

[57] ABSTRACT

A device for sealing the surface of a liquid in a cylindrical can having an annular lid retaining rim at its upper end defining an opening in the can. The device comprises a rigid circular disk of light weight material sized to pass freely through the opening in the can defined by the rim and float upon the surface of the liquid until a skin forms upon the surface of the liquid between the peripheral edge of the disk and the associated sidewall of the can. A radially disposed cutter is secured at its inner end to its central portion of the disk adjacent the upper surface of the disk. The cutter extends radially outwardly from the center of the disk and has a cutting blade at its outer end located in close proximity to the circular peripheral edge of the disk. A handle on the cutting element intermediate its ends facilitates rotation of the cutting element relative to the disk to move the cutting edge of the blade in cutting engagement with the skin formed on the surface of the liquid.

11 Claims, 4 Drawing Figures

LIQUID SURFACE SEALING DEVICE

BACKGROUND OF THE INVENTION

This invention relates in general to liquid sealing devices and deals more particularly with an improved device for sealing the surface of liquid stored within a container. The device is particularly adapted to provide a surface seal for a liquid of a type which has a tendency to harden at its exposed surface upon prolonged exposure to atmosphere forming a skin or relatively tough film which increases in thickness with passage of time. Such a condition is characteristic of oil base paint, for example. When the paint skin is ruptured hardened paint particles often break of and enter the remaining liquid paint to be picked up by a paint brush or roller and applied to the surface being painted.

Various sealing devices, such as temporary lids have been provided to solve the aforedescribed problem. However, when such a temporary lid is used it must be sized to pass through an opening in the container and, therefore, must have a surface area somewhat smaller than the surface area of the liquid which it is designed to cover, leaving a small area of the surrounding liquid surface exposed. When the surface of this exposed liquid dries the temporary lid adheres to the surrounding wall of the container and is difficult to remove. The present invention is concerned with this problem.

It is the general aim of the present invention to provide an improved device for temporarily sealing the surface of a liquid stored in a container to prevent hardening of the associated liquid surface. It is a further aim of the invention to provide a liquid surface sealing device and which may be easily removed from a container to facilitate access to the remaining liquid in the container.

SUMMARY OF THE INVENTION

In accordance with the present invention, an improved liquid surface sealing device for a liquid storage container essentially comprises a sealing member formed from a sheet of relatively rigid material and sized to pass freely through an opening in a upper end of the container. The sealing member has a peripheral shape substantially complementing the inner periphery of the container at the surface of the liquid and is adapted to float on the surface of the liquid in closely spaced relation to the inner wall of the container. A cutting element supported on the upper surface of the sealing member has a cutting blade at its outer end disposed in close relation to the peripheral edge of the sealing member. The cutting element is supported at its inner end by the sealing member for moving the blade along a path defined by the peripheral edge of the sealing member to cut through skin which may form at the surface of the liquid between the peripheral edge of the sealing member and the associated side wall of the container whereby to separate the sealing device from the container for removal from the container.

DETAILED DESCRIPTION OF PREFERRED EMBODIMENT

Figure 1:
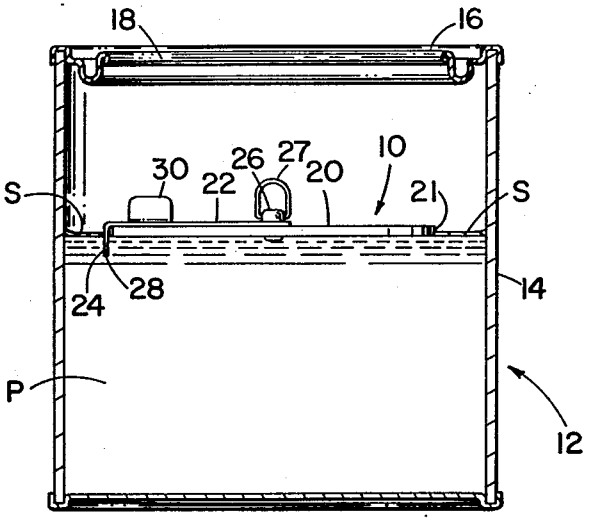
FIG. 1 is a vertical axial sectional view through a can containing paint or like material and having a sealing device embodying the present invention.
Figure 2:
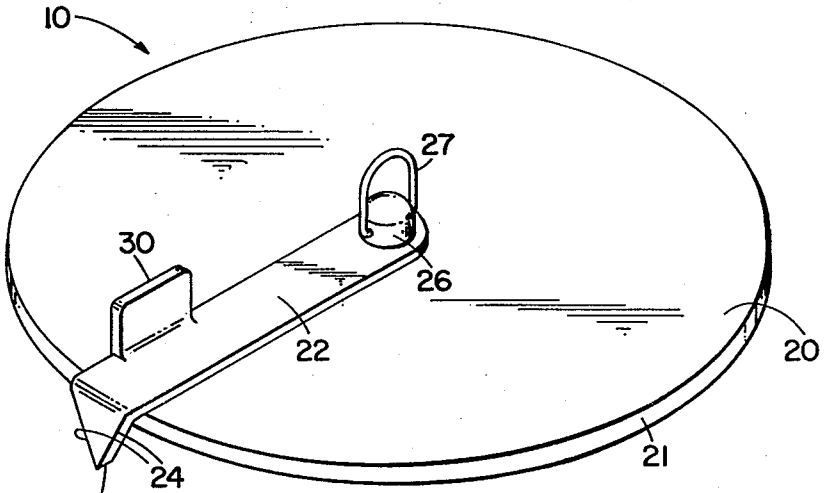
FIG. 2 is a perspective view of the sealing device shown in FIG. 1.

Turning now to the drawing, a sealing device embodying the present invention and designated generally by the reference numeral 10 is shown in association with a container indicated generally at 12. The illustrated container 12 is a can of the type usually used to store paint or like material and has a cylindrical body 14 and an annular lid retaining rim 16 at its upper end which defines a circular opening 18 in the upper end of the can. The illustrated can 12 contains a quantity of liquid or paint indicated by the letter P.

The sealing device 10, as shown in FIG. 1, is disposed in sealing engagement with the upper surface of the paint P and is adhered at its peripheral edge to the associated can side wall 14, some distance below the upper end of the can, by skin S which has formed in the annular space between the container body 14 and the peripheral edge of the sealing device 10. Thus, when the can is sealed by its lid (not shown) in a conventional manner, the sealing device 10 serves as a temporary lid to seal the surface of the paint P in the lower portion of the can 12 and effectively isolate it from the atmosphere in the can above the sealing device.

Figure 3:
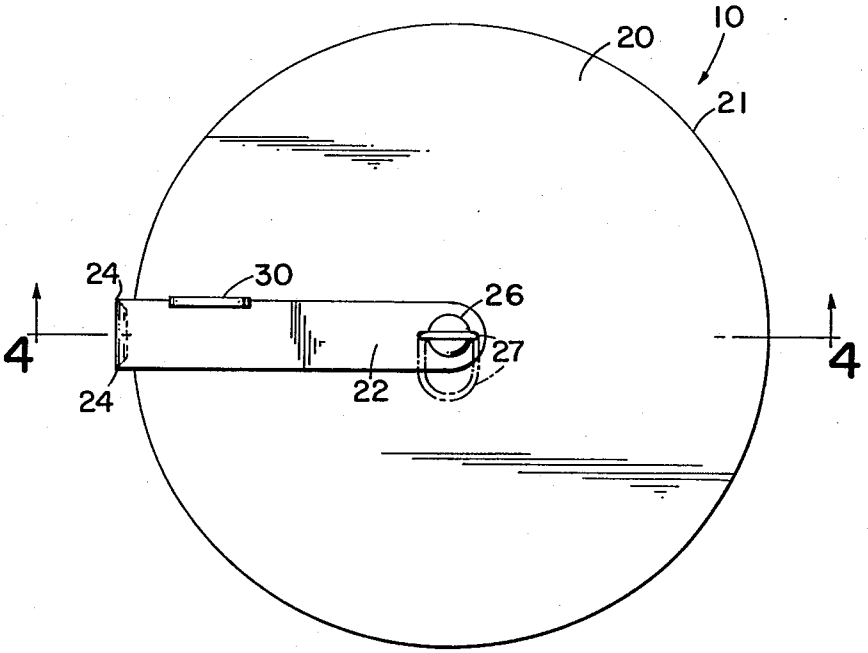
FIG. 3 is a plan view of the sealing device shown in FIG. 1.
Figure 4:
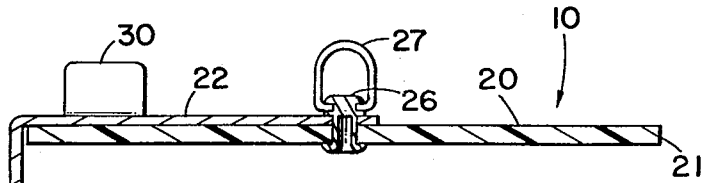
FIG. 4 is a sectional view taken along the line 4, 4 of FIG. 3.

Considering now the illustrated sealing device 10 in further detail, it is particularly adapated for use with a cylindrical can, such as the one shown, and comprises a sealing member or generally circular disk 20 of relatively rigid material, as for example, a light weight plastic material. The disk 20 is substantially flat and has a circular peripheral edge 21 the diameter of which is slightly smaller than the diameter of the opening 18 in the upper end of the can, defined by the circular rim 16, to enable the disk 20 to pass freely through the opening 18. The device 10 further includes a cutting element 22, which is preferably formed from flat metal and pivotally connected at its inner end to the sealing disk 20 adjacent the upper surface of the disk by a suitable fastener which may comprise a removable fastener such as a nut and bolt. However, the illustrated cutting element is secured by a headed rivet 26 to pivot about the center of the disk. A D-shaped ring or handle 27 is attached to the head of the rivet 26 to pivot between a raised position shown in FIG. 4 and a lowered position indicated by broken lines in FIG. 3.

The cutting element has a vertically disposed blade portion which includes at least one relatively sharp cutting edge 24 at its outer end and is located proximate the disk peripheral edge 21. The cutting edge 24 extends for some distance below the upper surface of the sealing disk 20 and is preferably arranged in generally normal relation to the plane of the upper surface of the disk. The lower end of the blade cutting edge 24 preferably terminates at a point located some distance below the lower surface of the disk 20 substantially as shown and indicated at 28, for a reason which will be hereinafter further evident.

The cutting element is preferably formed with a handle portion 30 intermediate its ends. The handle portion 30 of the illustrated element is formed by an upwardly bent portion of the element, substantially as shown in the drawing.

After some of the liquid in the container has been used and the container is to be stored, the sealing device 10 may be held by the central D-ring handle 27 and carefully placed on the surface of the liquid to float thereon. Thereafter, the container lid is afixed to the container and the container is placed on a shelf or the like for storage.

Since the diameter of the sealing disk 20 is somewhat smaller than the inside diameter of the can, a generally annular portion of the surface of the liquid between the peripheral edge of the disk and the side wall of the can will be exposed to the atmosphere in the can and above the sealing disk. This exposed liquid surface area will eventually harden forming a seal of skin between the peripheral edge of the sealing disk and the associated inner side wall of the can 14. When the can is opened at some later time, the sealing device 10 may be readily removed by grasping the handle portion 30 and rotating the cutting element 22 relative to the sealing member 20 and in cutting engagement with the skin which has formed on the liquid or paint between the peripheral edge of the disk and the can. When the sealing device 10 has been separated from the can 14, it may be readilly removed from the can through the opening 18. The surface of the liquid paint is now accessible to any brush which will pass through the opening 18.

After the sealing device 10 has been removed from the can, it may be cleaned with a suitable solvent or, if preferred, may be simply allowed to air dry so that the dried paint may be peeled off the device at a later time. If some liquid remains in the can after the second use, the sealing device may be again positioned on the surface of the liquid and the process repeated.

The device may also be used as a cutter to remove skin which has formed on the entire surface of a liquid within a suitable container. In this instance, the sealing device 10 is simply placed within the can and on the hardened surface of the skin. The sharp point on the cutting element blade is then pushed through the skin after which the cutting element is rotated relative to the disk 20 while the disk is held in a relatively fixed position to cut away the skin. However, since the skin is not adhered to the disk, other means must be employed to remove the skin from the can after it has been cut.

I claim:

1. A device for sealing the surface of a liquid stored within container, the liquid having a tendency to surface hardened upon exposure to atmosphere to form a skin, said device comprising sealing means for floating on the surface of the liquid in closely spaced relation to the inner surface of the container sidewalls and including a substantially flat sealing member of relatively rigid sheet material having a peripheral shape substantially complimenting the peripheral shape of the associated inner surface of the container sidewalls, and means for cutting skin formed on a portion of the surface of the liquid between the peripheral edge of the sealing member and the associated inner surface of the container sidewalls and including a cutting element supported on the upper surface of the sealing member and having a blade portion including a cutting edge proximate the peripheral edge of the sealing member, and means for connecting the cutting element to the sealing member to move with its cutting edge travelling in a path generally defined by the peripheral edge of the sealing member and in cutting engagement with the skin.

2. A device for sealing the surface of a liquid stored within a container as set forth in claim 1 wherein said cutting edge extends for some distance below the plane of the lower surface of said sealing member.

3. A device for sealing the surface of a liquid stored within a container as set forth in claim 2 wherein said blade portion teminates at a sharp point located some distance below the plane of the lower surface of said sealing member.

4. A device for sealing the surface of a liquid stored within a container as set forth in claim 1 wherein said cutting means includes a handle mounted on said cutting element.

5. A device for sealing the surface of liquid stored within a cylindrical container, the liquid having a tendency to surface hardened upon exposure to atmosphere to form a skin, the container having an annular rim at its upper end defining a lid receiving groove and a circular opening communicating with the interior of said container, said device comprising a substantially flat thin circular sealing disk of substantially rigid material having a diameter slightly smaller than the diameter of said circular opening to pass freely therethrough, and elongated cutting element disposed on the upper surface of said sealing disk and in generally radially extending relation to said sealing disk, said cutting element having a cutting blade portion at its outer end proximate the peripheral edge of said sealing disk and including a cutting edge, said blade portion extending for some distance below the plane of the lower surface of said sealing disk, and means securing the inner end portion of said cutting element to the central portion of said sealing disk for rotation about a central axis of said sealing disk generally normal to the surface of said sealing disk.

6. A device for sealing the surface of liquid stored within a cyclindral container as set forth in claim 5 wherein said blade terminates at a point.

7. A device for sealing the surface of liquid stored within a cylindrical container as set forth in claim 5 including a handle attached to said cutting element.

8. A device for sealing the surface of liquid stored within a cylindrical container as set forth in claim 7 wherein said handle is attached to said cutting element intermediate the inner and outer ends of said cutting element.

9. A device for sealing the surface of liquid stored within a container having a cylindrical sidewall and an annular lid retaining rim at its upper end defining a circular opening communicating with the interior of the container, said device comprising a substantially flat circular sealing disk having a diameter slightly smaller than the diameter of said opening to pass freely therethrough, said device being adapted to be positioned on the surface of liquid stored within the container to float on the liquid surface and in spaced relation to an associated portion of the inner surface of the container sidewall, and cutting means mounted on the upper surface of said sealing disk for rotation relative to said sealing disk and about a circular path around the peripheral edge of said disk to cut skin formed by said liquid between said peripheral edge and the associated cylindrical sidewall of said container, whereby to effect separation of the sealing disk from the skin adhered to the sidewall of the container to expose the surface of the liquid below the sealing disk when the disk is removed from the container.

10. A device for sealing the surface of liquid stored within a container as set forth in claim 9 wherein said cutting means comprises an elongated cutting member pivotaly connected at one end to the center of the sealing disk and extending radially outwardly from said center.

11. A device for sealing the surface of liquid stored within a container as set forth in claim 10 wherein said cutting means includes a blade portion at the outer end of said elongated member and extending to a position below the plane of the lower surface of said disk.

* * * * *